United States Patent [19]

Holgersson

[11] 4,094,735

[45] June 13, 1978

[54] METHOD OF PULPING WITH SULFITE LIQUOR CONTAINING FORMIC ACID ESTERS

[75] Inventor: Sigbjorn P. H. E. Holgersson, Gavle, Sweden

[73] Assignee: Kopparfors AB, Ockelbo, Sweden

[21] Appl. No.: 759,744

[22] Filed: Jan. 17, 1977

Related U.S. Application Data

[63] Continuation of Ser. No. 610,075, Sep. 3, 1975, abandoned.

[30] Foreign Application Priority Data

Sep. 6, 1974 Sweden ..... 7411268

[51] Int. Cl.[2] ..... D21C 3/04; D21C 3/06; D21C 3/20

[52] U.S. Cl. ..... 162/76; 162/83

[58] Field of Search ..... 162/76, 72, 83

[56] References Cited

U.S. PATENT DOCUMENTS

| | | | |
|---|---|---|---|
| 2,054,854 | 9/1936 | Dreyfus | 162/76 |
| 2,070,585 | 2/1937 | Dreyfus | 162/76 X |
| 2,645,633 | 7/1953 | Richmond et al. | 162/76 X |
| 2,743,179 | 4/1956 | Corbin et al. | 162/76 |
| 3,296,065 | 1/1967 | O'Brien et al. | 162/76 X |
| 3,560,331 | 2/1971 | Beclik | 162/76 |

*Primary Examiner*—S. Leon Bashore
*Assistant Examiner*—Steve Alvo
*Attorney, Agent, or Firm*—Haseltine, Lake & Waters

[57] ABSTRACT

In the sulfite pulping, the yield of pulp is increased, if at least one of a selected group of formic acid esters is added to the cooking liquid before the impregnation of the wood.

3 Claims, No Drawings

METHOD OF PULPING WITH SULFITE LIQUOR CONTAINING FORMIC ACID ESTERS

This is a continuation of application Ser. No. 610075 filed Sept. 3, 1975 now abandoned.

BACKGROUND OF THE INVENTION

In the normal sulfite pulping of wood the lignin and the greater part of the hemicellulose are dissolved, and sometimes also a minor part of the alpha cellulose is dissolved. A substantially pure alpha cellulose product may be desired, if the pulp has to be used for the manufacturing of viscose cellulose, but in the case of paper pulp the removal of the hemicellulose involves, as a rule, only a loss of yield.

SUMMARY OF THE INVENTION

It has now been proved that the yield as well as the strength of the pulp will be increased, if the cooking liquid is supplied with small quantities of at least one formic acid ester (formate) of hexyl alcohol or of an unsubstituted or methyl-substituted norbornyl alcohol. The formates have the general structural formula:

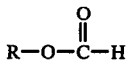

where R is thus a hexyl group or an unsubstituted or methylsubstituted norbornyl group.

Consequently, the invention consists in that at least one of the formates mentioned above is, before the impregnation of the wood with cooking liquid, added to said liquid in an amount of at least 0.02 mol, preferably at least 0.1 mol, as calculated per ton (1000 kg) absolutely dry wood. Generally, it may be sufficient to add one of said substances, but two or more of them may also be added. Preferably, the addition takes places immediately before the introduction of the cooking liquid into the digester. Before the addition the formate or formates may be dispersed in water by means of a non-ionic dispersing agent, and, if desired, the formates may before that be dissolved in a suitable solvent such as turpentine, cymene or diethylbenzene.

As mentioned above, the formate or formates in question must be added in an amount of at least 0.02 mole. This value may be regarded as a limit, below which no appreciable effect can be observed. Among the agents useful as additives according to the invention endo-fenchyl formate and exo-norbornyl formate have proved to be especially active.

The new method of sulfite cooking is particularly applicable when using spruce wood as raw material, but also other kinds of coniferous wood, such as pine wood, for instance, may be used. Also hardwood may be used in mixture with coniferous wood.

DETAILED DESCRIPTION OF A PREFERRED EMBODIMENT

As suitable formates defined by the structural formula stated above the following agents may be mentioned:

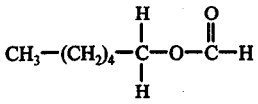

hexyl formate

-continued

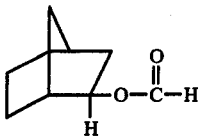

exo-norbornyl formate

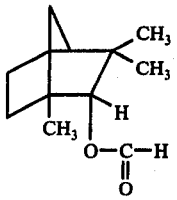

endo-fenchyl formate

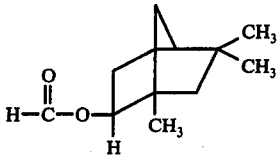

exo-isofenchyl formate

In what way these formates exercise their favorable influence on the sulfite cooking has not yet been entirely explained, but observations hitherto made seem to indicate that the agents in question counteract a condensation or polymerisation of the lignin. In the pulping, the cooking liquid has above all for its purpose to bring the lignin of the wood into solution by means of sulfonation. Thereby the carbon-oxygen bonds are broken, and reactive and rapidly sulfonatable intermediary substances of the benzylium ion typ or with a quinone methide structure are formed. It is known that the sulfonation of these substances occurs in competition with lignin condensation reactions, in which benzylium ions or quinone methide (according to the conditions) will, over an aromatic substitution, react with another phenylpropane unit. In this way a new and stable carbon-to-carbon bond is formed, and thus the process results in an increase of the size of the lignin molecules. Consequently, this lignin condensation counteracts the desirable dissolving action of the sulfonating cooking liquid.

By thorough investigations it has been elucidated that, during the conditions prevailing during sulphite cooking, the formates are more or less rapidly hydrolyzed into the corresponding alcohol and formic acid. It has now been presumed that the formic acid formed obstructs the lignin condensation reaction mentioned above, and such an influence may probably occur in two different ways. Firstly, the formic acid may act directly as a reduction agent thus reducing some of the benzylium ions or quinone methides (Analogous reactions are known). The reaction products then formed cannot be condensed in the way as mentioned above concerning benzylium ions or quinone methides. The second possible way, also dependent on the reducing action of the formic acid, means that thiosulfate is formed by reaction between the formic acid and sulfur compounds in the cooking liquid. Owing to their high nucleo-philic capacity the thiosulfate ions will then very rapidly react with the benzylium ions or the quinone methides which are thus prevented from undergoing said lignin condensation.

Formic acid is normally present in the cooking liquid, though in varying quantities. Together with the formates added according to the invention this formic acid may have a favorable influence, as long as its concentration is not high enough to cause a dominance of detrimental secondary effects. Thus, it may be very suitable to add formic acid in case the cooking liquid has a very low original content thereof. Generally, however, the supplemental addition of formic acid should be lower than 25% of the weight of the added amount of formate.

It has been proved that the best effect of an addition of the agents mentioned above will be achieved, if the content of total $SO_2$ in the cooking liquid is at least 1.5 times greater than the content of combined $SO_2$. This means that the invention may be applied not only in the old pulping with acid sulfite but also in the modern pulping with bisulfite, such as magnesium bisulfite, for instance.

The invention will be illustrated by the following examples. All cookings with acid sulfite have been carried out in a laboratory scale, but the processes are directly applicable in large-scale production. The examples of pulping with bisulfite are taken directly from the operation of a large continuous digester.

In the laboratory experiments, a laboratory digester having a volume of 8 liters was charged with dry chips of spruce wood (about 1 kg absolutely dry weight) and 4 liters preheated cooking acid containing 6.0% total $SO_2$ and 1.7% $SO_2$ bound to CaO. The starting temperature was 60° C. Each cooking began with a 2 hours long impregnation period, during which the temperature was successively raised to 80° C. After the impregnation the supply of heat was increased such that a final temperature of about 130° C was reached 5 hours after the start. The total time of cooking fluctuated at the various experiments. At the end of the cooking a common degassing took place, whereupon the cooking was stopped in the usual way. The yield of pulp from each experiment was estimated by a thorough weighing of chips having a known percentage of humidity in combination with a thorough washing, disintegration drying and weighing of the quantity of pulp obtained.

During the whole series of experiments a unitary quality of chips was used, but to ensure that the results were not influenced by different times of storing, comparative cookings without the addition of yield increasing agents were carried out at equal intervals. All these comparative tests showed a very good correspondence, and the yield of unscreened pulp was, on an average, 51.4% at a kappa-number of 40. The brightness was measured to 64% SCAN, and the time of cooking was, on an average, 9.0 hours.

In all experiments shown in the following table I there were mixed 100 parts by weight formate, 3 parts by weight formic acid and 30 parts by weight nonionic dispersing agent, and the mixture was dispersed in water in the ratio 1:20. The aqueous dispersion was admixed in the cooking acid immediately before the latter was pumped into the digester.

Table I

| Example No. | 1 | 2 | 3 |
|---|---|---|---|
| Additive | Exo-iso-fenchyl formate | Endo-fenchyl formate | Exo-nor-bornyl formate |
| Added g/ton abs. dry wood | 24 | 96 | abt 10,000 |
| Cooking time in hours | 8.5 | 8.5 | 9.1 |
| Kappa-number | 38 | 40 | 35 |
| Brightness SCAN | 69.5 | 70.0 | 69.5 |
| Yield of unscreened pulp, % | 55.5 | 57.2 | 56.2 |

The experiments with continuous bisulfite pulping in large-scale production were carried out as follows:

Chips of spruce wood were fed from a chip bin over a chip meter (formed as a winged wheel meter) and a low-pressure feeder (i.e. a rotary vane feeder) into a steaming vessel which was formed as a horizontal cylinder containing a feed screw. Fresh steam was supplied from below through the body of chips to maintain a pressure of 1.5 atm. gauge in the steaming vessel. The time of stay in the steaming vessel was 2-4 minutes. Steam mixed with air expelled from the chips was vented through the chip bin owing to leakage through the vane feeder and the chip meter, but it could also be discharged from the steaming vessel in a controlled amount through a specific venting conduit.

From the steaming vessel the chips dropped through the chip chute down into a high pressure feeder, where they, by means of circulating cooking acid, were stuffed in that valve chamber while it was in the vertical position. When this valve chamber, on the rotation of the cock, was turned to the horizontal position, more cooking acid was supplied to convey the chips to the top separator which is an inclined cylinder containing a concentric screw adapted to convey chips and acid. In its lower part said cylinder has a strainer to withdraw the acid circulating through the high pressure feeder. On their way from the high pressure feeder to the outlet end of the top separator the steamed chips were impregnated during about 3 minutes at 110° C and 12 atm. gauge. Cooking acid heated to about 90° C by means of steam from lye evaporation was supplied in the top separator in such an amount that the ratio wood: cooking acid was adjusted to 1:2. The acid contained about 8.5% by weight total $SO_2$ and 4.0% by weight MgO-combined $SO_2$.

From the top separator the chips and the acid were tilted down into the steam space of the digester which consisted of a vertical cylinder having a diameter of 4 meters, a height of 48 meters and a volume of 600 $m^3$. The output per day could be 350 ton pulp. The upper half of the digester was used for the cooking proper, while the lower half was used for a countercurrent high heat washing.

Live steam was supplied to the steam space in such a way that the contents of the digester were instantaneously heated to full cooking temperature, in this case 158°-160° C. At the end of the cooking zone the waste liquor was discharged through a pipe and led to a recovery unit. In the lower zone, i.e. the washing zone, the pulp was washed with water supplied through a conduit, and the washed pulp was withdrawn through an outlet at the bottom of the digester.

The following table II includes three examples. One of them was carried out without additives to serve as a comparative test, while in the other examples 50 g endofenchyl formate (EFF) were added per ton absolutely dry wood. In the same way as in the laboratory experiments described above, the formate was dispersed in water (in one example together with 3% by weight formic acid) by means of a non-ionic dispersing agent, and the dispersion was supplied to the cooking acid immediately before the high pressure feeder.

Table II

| Example No. | 4 | 5 | 6 |
|---|---|---|---|
| Additive g/ton dry wood | No addition | 50 g pure EFF | 50 g pure EFF + 3% formic acid |
| % total $SO_2$ in the acid | 8.5 | 8.5 | 8.5 |
| % bound $SO_2$ in the acid | 4.0 | 4.0 | 4.0 |
| Kappa-number | 45 | 45 | 45 |
| Breaking length at 40° SR, m | 8500 | 8700 | 9600 |
| Breaking length in m. after beating 20 min. | 6600 | 6800 | 8500 |
| Tearing strength in g. at | | | |

Table II-continued

| Example No. | 4 | 5 | 6 |
|---|---|---|---|
| 8000 m breaking length | 85 | 90 | 101 |
| Brightness SCAN | 69 | 72 | 75 |
| Yield of unscreened pulp, % | 53.0 | 56.0 | 57.5 |

Experiments in large-scale production have also been carried out while adding hexyl formate together with 3% formic acid, calculated on the weight of the formate. The results appear from the following table III, where the comparative test is the same as in table II.

Table III

| Example No. | 4 | 7 | 8 |
|---|---|---|---|
| Additive g/ton dry wood | No addition | 50 g HF + 3% formic acid | 100 G HF + 3% formic acid |
| % total $SO_2$ in the acid | 8.5 | 8.5 | 8.5 |
| % bound $SO_2$ in the acid | 4.0 | 4.0 | 4.0 |
| Kappa-number | 45 | 45 | 45 |
| Breaking length at 40° SR, m | 8500 | 8600 | 9300 |
| Breaking length in m. after beating 20 min. | 6600 | 6800 | 8300 |
| Tearing strength in g. at 8000 m.breaking length | 85 | 87 | 99 |
| Brightness SCAN | 69 | 71 | 74 |
| Yield of unscreened pulp, % | 53.0 | 55.8 | 57.3 |

I claim:

1. In the method of producing wood pulp by cooking wood in a sulfite cooking liquid, the improvement comprising adding to said sulfite cooking liquid, prior to bringing it into contact with the wood, at least one formic acid ester having the formula

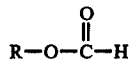

where R is a hexyl group or an unsubstituted or methyl-substituted norbornyl group, in an amount of from 0.02 to 71 moles of ester per ton of absolutely dry wood and from 0 to 25% by weight of formic acid based on the weight of the added ester and cooking the wood with said cooking liquid to produce a pulp of increased yield and strength.

2. The method of claim 1, wherein the ester is added in the amount of 0.1 mole per ton of absolutely dry wood.

3. Th method of claim 1, wherein the ester is dispersed in water by means of a non-ionic dispersing agent prior to addition to the sulfite cooking liquid.

* * * * *